US007077101B2

(12) United States Patent
Poola et al.

(10) Patent No.: US 7,077,101 B2
(45) Date of Patent: Jul. 18, 2006

(54) HYBRID FUEL INJECTION SYSTEM

(75) Inventors: Ramesh B. Poola, Naperville, IL (US); Richard J. Lill, Naperville, IL (US); Paul Gottemoller, Palos Park, IL (US); Michael B. Goetzke, Orland Park, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 306 days.

(21) Appl. No.: 10/218,716

(22) Filed: Aug. 14, 2002

(65) Prior Publication Data

US 2004/0031468 A1 Feb. 19, 2004

(51) Int. Cl.
*F02B 3/00* (2006.01)

(52) U.S. Cl. ..... 123/299; 123/575

(58) Field of Classification Search ..... 123/299, 123/300, 575, 576, 577, 578, 456, 446
See application file for complete search history.

(56) References Cited

U.S. PATENT DOCUMENTS 4,075,996 A * 2/1978 Hisserich ..... 123/143 A
4,754,737 A * 7/1988 Ishida et al. ..... 123/500
5,072,706 A * 12/1991 Eblen et al. ..... 123/299
5,092,305 A * 3/1992 King ..... 123/575
5,170,751 A * 12/1992 Tosa et al. ..... 123/25 C
5,647,316 A * 7/1997 Hellen et al. ..... 123/299
5,887,799 A * 3/1999 Smith ..... 239/585.1
5,890,459 A * 4/1999 Hedrick et al. ..... 123/27 GE
6,032,641 A * 3/2000 Aketa et al. ..... 123/299
6,142,107 A * 11/2000 Stutzenberger ..... 123/27 GE
6,491,016 B1 * 12/2002 Buratti ..... 123/299

OTHER PUBLICATIONS

Hlousek et al, "Electronically Controlled Injection Rate Shaping for Medium Speed Diesel Engines," International Council on Combustion Engines, Congress 2001, Hamburg, pp. 511-517.

* cited by examiner

*Primary Examiner*—Carl S. Miller
(74) *Attorney, Agent, or Firm*—Cook, Alex, McFarron, Manzo, Cummings & Mehler, Ltd.

(57) ABSTRACT

A hybrid fuel injection system which allows electronic control over the injection processes, wherein selective rate shaping and multiplicity of injections is possible. The hybrid fuel injection system consists of an add-on common rail system (CRS) which provides supplemental fuel injections with respect to the main fuel injections provided by a unit pump system (UPS). Additionally, the CRS can serve to provide fuel injections as necessary to effect a "limp-home" mode of engine operation in the event of a failure of the UPS. Both the CRS and the UPS use common fuel supply, return, injector, and electronic controller.

4 Claims, 3 Drawing Sheets

HYBRID FUEL INJECTION SYSTEM

TECHNICAL FIELD

The present invention relates to fuel injection systems for internal combustion engines, particularly diesel engines. More particularly, the present invention relates to an electronically-controlled hybrid fuel injection system for providing selective fuel injection rate shaping and multiplicity of injections.

BACKGROUND OF THE INVENTION

To meet future EPA emissions standards, large bore medium speed diesel engines need greater flexibility and reliability on the fuel injection equipment with regard to fuel metering, injection timing, injection pressure, rate of injection (rate shaping) and multiple (pre-, post-, or split) injections independent of engine speed. A production unit pump system (UPS) offers the advantage of design simplicity with flexibility on electronically-controlled injection timing.

However, the rate of injection and injection pressure are solely dependent upon cam profile and engine speed, and are optimized for full load operating conditions. It is impossible to provide split injections and/or injection pressure control and pressure level. At engine idle and lower speeds, the UPS cannot generate adequate high injection pressures that are necessary to achieve complete combustion.

In order to overcome these shortcomings, advancements to the UPS such as current controlled rate shaping (CCRS) and advanced unit pump system (AUPS) are being developed by the fuel injection equipment manufacturers. For example, see International Council on Combustion Engines, 2001 Congress, Hamburg, Germany, pages 511 through 517. Also, several new injection systems, such as common rail system (CRS) and amplifier piston common rail system (APCRS), are currently being developed. The CCRS concept offers the advantage of excellent retrofit capability with incremental cost, and it can provide initial injection rate shaping (boot injection) but limited by the cam profile, engine speed, and needle valve opening pressure. The AUPS can provide controlled injection pressure that is independent of engine speed. However, it cannot provide split injections that are essential to reduce certain exhaust emissions, engine noise, and improve fuel efficiency.

The CRS and APCRS systems (both being non-UPS) offer flexibility to control the injection timing and injection pressure independent of cam profile and/or engine speed. However, the high pressure CRS allows only controlling simple and multiple injections. Higher pressure peaks at the end of injection event and pressure pulsations at higher injection quantities limit its application to medium speed, large bore diesel engines. The APCRS, using either hydraulically- or mechanically-controlled pressure amplifier concepts, has the potential to permit pre- and post-injections, and variations in injection rate shaping. However, the boot pressure ratio is not variable because of a geometrically-fixed amplification ratio.

A more critical hardware constraint is the layout of the low-pressure system avoiding pressure pulsations. In comparison, the production UPS and the delineated alternative fuel systems cannot offer the desired flexible injection (cam and speed independent injection pressure, rate shaping, and multiple injections) while maintaining the reliability and cost effective retrofit capability.

Accordingly, what remains needed in the art is a fuel injection system which is a hybrid, the system allowing electronic control over the injection processes, wherein selective rate shaping and multiplicity of injections is made possible.

SUMMARY OF THE INVENTION

The present invention is a hybrid fuel injection system which allows electronic control over the injection processes, wherein selective rate shaping and multiplicity of injections is made possible.

The hybrid fuel injection system according to the present invention combines the benefits of both the high pressure common rail system (CRS) and the unit pump system (UPS) to achieve greater flexibility on fuel metering, injection timing, injection pressure, rate of injection, pre-injection, split injections, and post-injection. Further, it has excellent retrofit capability because the CRS will be added to the existing UPS. The hybrid fuel injection system combines the benefits of UPS and CRS with a potential to provide a CRS retrofit kit to an existing UPS. The hybrid fuel injection system offers the potential of providing pre-, post-, or multiple (split) fuel injections independent of cam profile and engine speed while combing the benefits of advanced unit pump systems (which can provide controllable injection pressure and rate shaping).

The hybrid fuel injection system consists of an add-on CRS which provides supplemental fuel injections with respect to the main fuel injections provided by a UPS (inclusive of an advanced UPS and CCRS). The CRS consists of a small size high pressure pump that can generate high injection pressures independent of engine speed/cam profile and a high pressure rail accommodating fuel quantity that is sufficient for pre-, post- (at all engine speed/load conditions), or main fuel injection quantity at engine idle condition. Additionally, the CRS can serve to provide fuel injections as necessary to effect a "limp-home" mode of engine operation in the event of a failure of the UPS. Both the CRS and the UPS use common fuel supply, return, injector, and electronic controller.

In a first embodiment, the CRS has an electronically-controlled solenoid for each cylinder which effects the beginning and end of supplemental fuel supply directly to the fuel passage communicating with the nozzle passage of the nozzle assembly of the fuel injector. In this first embodiment, the UPS and the CRS both utilize the nozzle assembly of the fuel injector to control fuel exiting the fuel injector. In a second embodiment, the electronically-controlled solenoid directs fuel into an auxiliary passage in the fuel injector which communicates with a sac. In this second embodiment, injection of fuel by the CRS is entirely independent of the UPS and of the nozzle assembly and its needle motion.

In operation during engine idle and part load conditions, only CRS may be functional, wherein opening of the electronically-controlled solenoid turns off the UPS. The high pressure solenoid in the CRS will deliver high pressure fuel either in the form of a single injection or in the form of multiple injections. The high pressure pump in the CRS, driven by, for example, an electrical motor or the crankshaft, pressurizes the fuel and maintains the accumulator at a preset pressure. The entire CRS unit acts independent of UPS, but the operation logic is preferably built into a single electronic control unit (ECU).

During medium through full load/speed engine operating conditions, the CRS will begin the pre-injection and/or multiple injections of a small fuel quantity followed by the main fuel injection event actuated by the UPS. Subsequent to the UPS main fuel injection event, the CRS can perform one or more additional fuel injections post the main fuel injection event, if necessary. In this mode of operation, the majority of the fuel is still delivered by the UPS whose injection pressures and rate of injection are dictated by the cam profile, engine speed, and actuation of its solenoid. In the event of actuation of the aforementioned "limp-home" mode, the CRS will completely control the delivery of fuel to the cylinders.

Accordingly, it is an object of the present invention to provide a hybrid fuel injection system for providing a main fuel injection event and further providing selection of fuel injection rate shaping and multiple fuel injections.

This and additional objects, features and advantages of the present invention will become clearer from the following specification of a preferred embodiment.

DESCRIPTION OF THE PREFERRED EMBODIMENT

Figure 1:
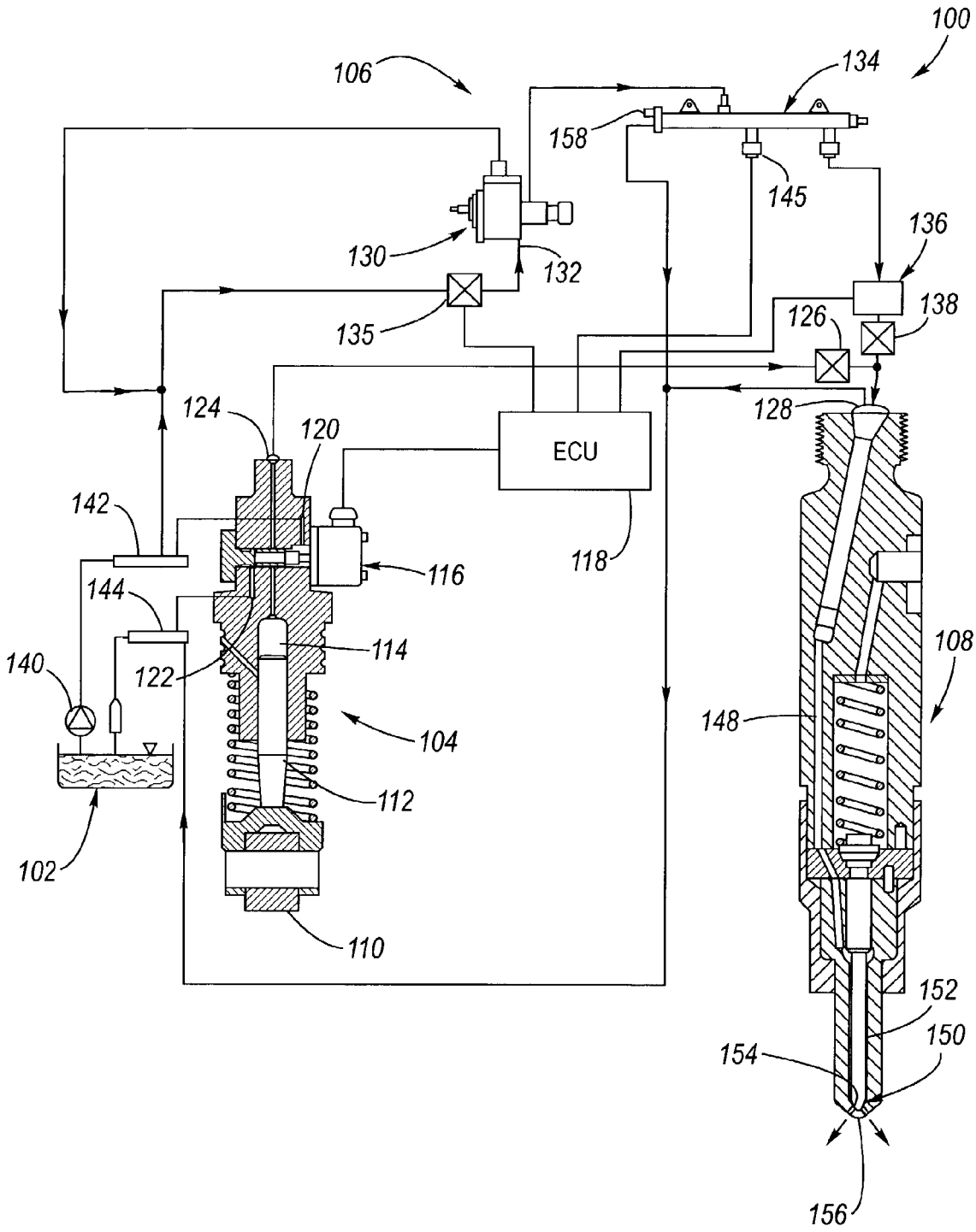
FIG. 1 is a first schematic depiction of a hybrid fuel injection system according to a first embodiment of the present invention.

Referring now to the drawing, FIG. 1 depicts a first embodiment of the hybrid fuel injection system 100 according to the present invention. A fuel tank 102 supplies fuel via various fuel lines to both a unit pump system (UPS) 104 and a common rail system (CRS) 106. The outputs of the UPS 104 and the CRS 106 are input to a fuel injector 108. In this regard, there is one UPS respectively for each fuel injector, and the CRS is common to all fuel injectors.

Each UPS 104 provides the main fuel injection to its respective fuel injector 108. The UPS is of common construction, including, for example a cam roller follower 110 for following a cam 115, a plunger 112, a pumping space 114, a pump solenoid valve 116 operatively connected to an electronic control unit (ECU) 118, a fuel inlet 120, a leakage fuel drain 122 and a pressurized fuel outlet 124 which is connected via tubing to a UPS check valve 126, which, in turn, communicates with the fuel input 128 of the fuel injector 108.

The CRS 106 includes an electrically-operated high pressure fuel pump 130 which receives fuel at a low pressure fuel inlet 132 and is operated on command of the ECU 118 via a throttle valve 135. The high pressure fuel pump 130 supplies highly pressurized fuel to a high pressure accumulator 134. A CRS solenoid valve 136 is provided respectively for each fuel injector. The solenoid valve 136 provides high pressure fuel, selectively at the command of the ECU 118 in association with a pressure sensor 145, from the high pressure accumulator 134 to a CRS check valve 138, which, in turn, communicates with the fuel input 128 of the fuel injector 108. A maximum pressure valve 158 prevents over pressurization of the accumulator 134.

Fuel is delivered from the fuel tank 102 via a fuel pump 140 to a low pressure delivery rail 142 which supplies fuel to the UPS fuel inlet 120 and the CRS fuel inlet 132. A low pressure return rail 144 accepts return of fuel.

In general operation, the UPS 104 supplies the major fuel injection event, and the CRS 106 supplies one or more auxiliary fuel injections which may precede, coincide with, or follow the main injection event of the UPS. Accordingly, the rate shape of the main fuel injection event may be electronically configured by commands of the ECU and/or the UPS (inclusive of an advanced UPS and CCRS), and/or one or more fuel injections may additionally be effected.

Figure 2:
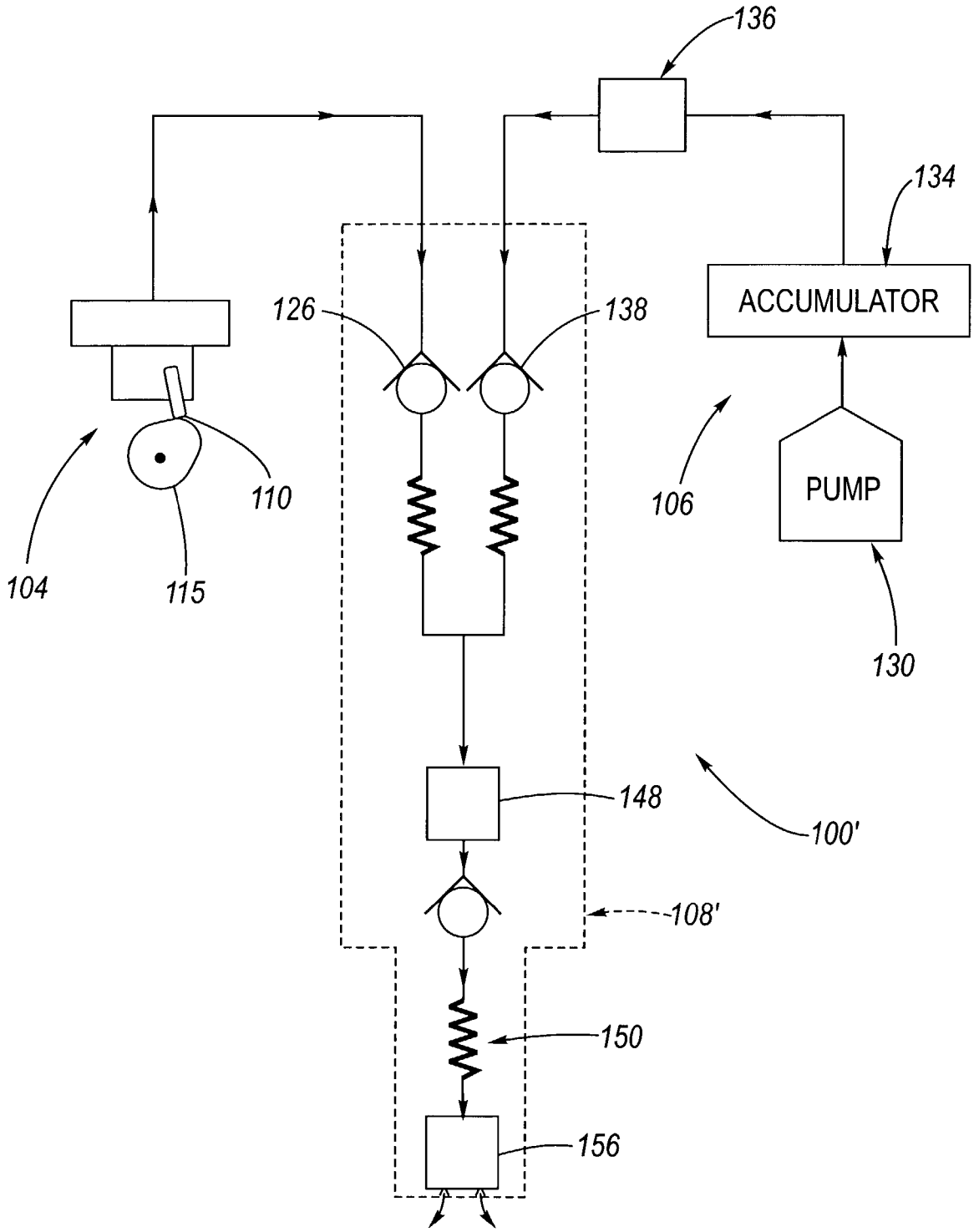
FIG. 2 is a second schematic depiction of the hybrid fuel injection system according to the first embodiment of the present invention.

In the hybrid fuel injection system 100' depicted at FIG. 2, the foregoing description applies, wherein now the fuel injector 108' is modified to integrally include the check valves 126 and 138.

In the present embodiments as depicted at FIGS. 1 and 2, the injections of both the UPS and the CRS are effected through a common injector passage 148 to the nozzle assembly 150, wherein there must be physical movement of the injector needle 152 with respect to its seat 154 in order for fuel from either the UPS or the CRS to pass out the nozzle 156 and thereby be injected into the cylinder by either of the UPS and CRS, operating singly or in combination.

Figure 3:
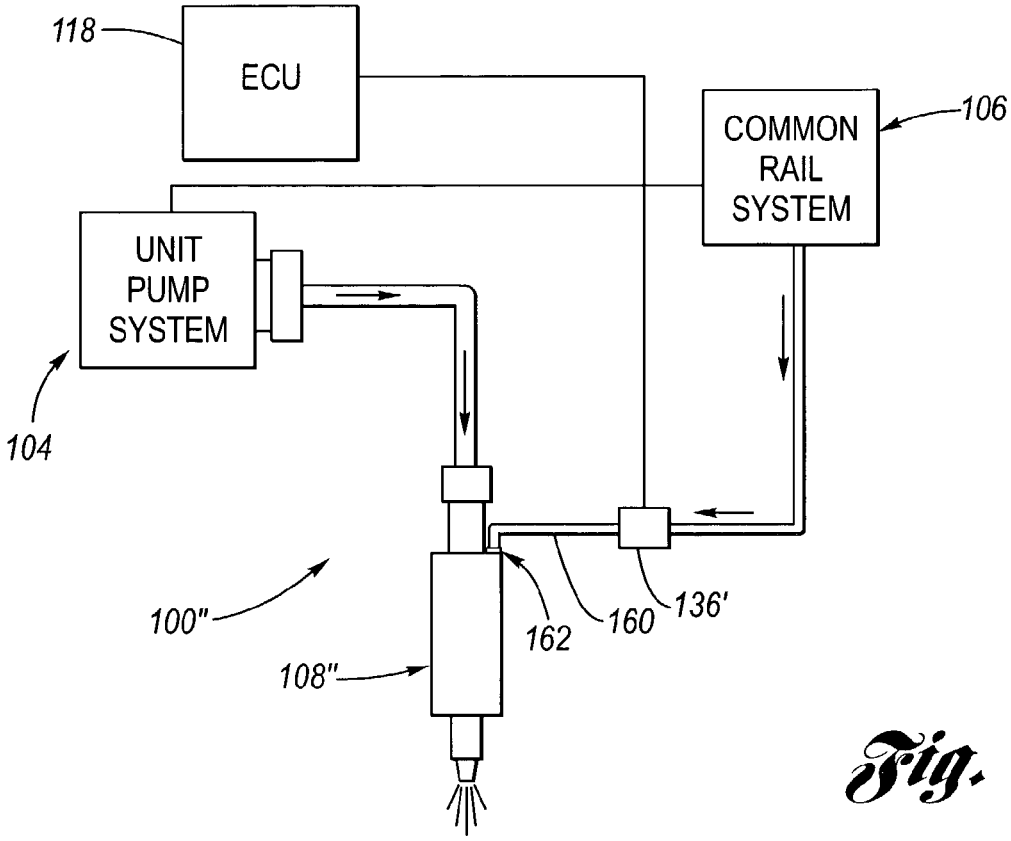
FIG. 3 is a schematic depiction of a hybrid fuel injection system according to a second embodiment of the present invention.
Figure 4:
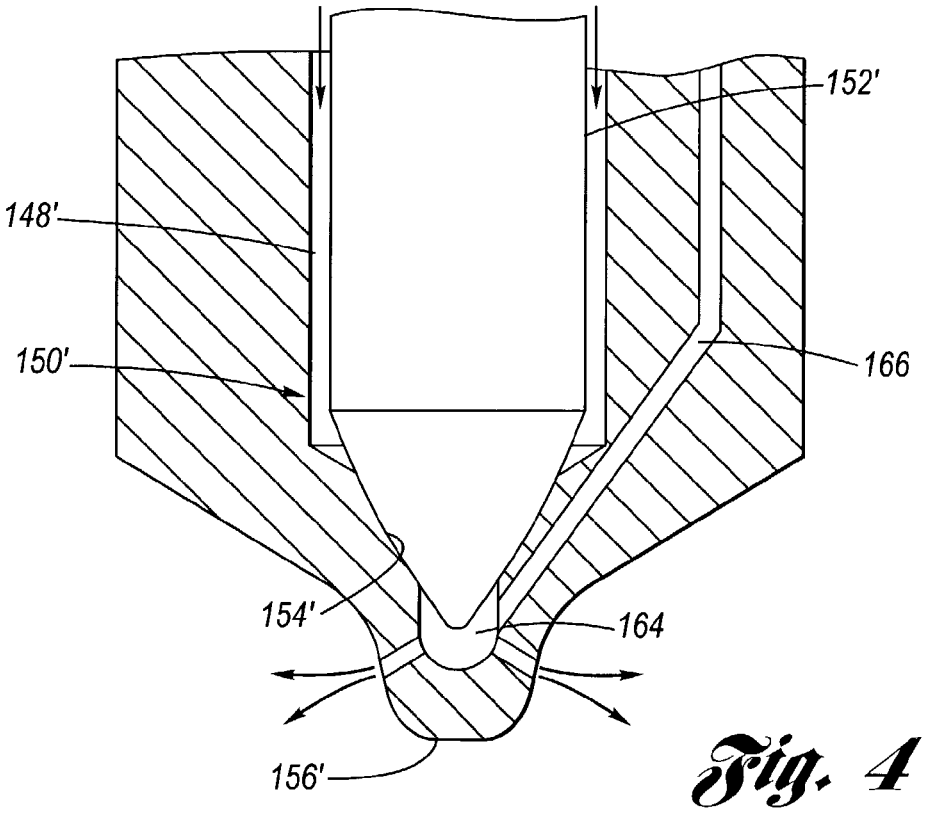
FIG. 4 is a detailed, partly-sectional view of the tip of a fuel injector according to the second embodiment of the present invention.

Referring now additionally to FIGS. 3 and 4, a second embodiment of the hybrid fuel injection system 100" according to the present invention will be detailed. In this regard, the unit pump system 104, the common rail system 106 and the ECU 118 as discussed hereinabove with respect to FIGS. 1 and 2 are utilized.

Now, the fuel injector 108" has an injector passage 148' which only communicates with the UPS 104. The CRS 106 is connected via tubing to a CRS solenoid valve 136' and then via tubing 160 to a port 162 in the fuel injector 108". The port 162 communicates with a sac 164 via a passageway 166 internal to the fuel injector 108". The CRS solenoid valve 136' is operated under command from the ECU 118.

Operationally, the UPS 104 supplies the major fuel injection event, and the CRS 106 supplies one or more auxiliary fuel injections which may precede, coincide with, or follow the main injection event of the UPS. Accordingly, the rate shape of the main fuel injection event may be electronically configured by commands of the ECU and or UPS (inclusive of advanced UPS and CCRS), and/or one or more fuel injections may additionally be accomplished. In this regard, it will be appreciated that the fuel injections by the CRS 106 are entirely independent of the nozzle assembly 150' wherein there is no need for movement of the injector needle 152' with respect to its seat 154' to effect a CRS fuel injection. CRS fuel injection occurs when the CRS solenoid valve 136' opens, whereupon fuel under pressure flows into the sac 164 and then injects into the cylinder through the apertures of the nozzle 156'.

In operation with respect to the recounted embodiments 100, 100', 100" during engine idle and part load conditions, only the CRS 106 may be functional, wherein opening of the electronically controlled solenoid valve 136, 136' turns off the UPS 104. The high pressure solenoid valve 136, 136' in the CRS 106 will deliver high pressure fuel either in the form of a single injection or in the form of multiple injections. The high pressure pump 130 in the CRS, which is driven by, for example, an electrical motor or the crankshaft, will pressurize the fuel and maintain the accumulator 134 at a preset pressure. The entire CRS unit acts independent of the UPS but the operation logic is built into the ECU 118.

During medium through full load/speed engine operating conditions, the CRS 106 will begin the pre-injection and/or multiple injections of a small fuel quantity, for example less than 20% of the total fuel injection quantity, followed by the main fuel injection event actuated by the UPS 104. Subsequent to the UPS main fuel injection event, the CRS can perform one or more additional fuel injections post the main fuel injection event, if necessary. In this mode of operation, the majority of the fuel is still delivered by the UPS whose injection pressures and rate of injection are dictated by the profile of its cam 115, engine speed, and actuation of its pump solenoid valve 116. In the event of actuation of an ECU instituted and controlled "limp-home" mode due to a failure of the UPS, the CRS will completely control the delivery of fuel to the cylinders.

For engines having a production UPS, the hybrid fuel injection system 100, 100', 100" may be provided by installation of a retrofit kit. The retro-fit kit consists of a CRS 106 and appropriate tubing, a new ECU 118 or a reprogrammed existing ECU. In the case of the hybrid fuel injection system 100', 100" depicted at FIGS. 2 through 4, a modified fuel injector 108', 108" is respectively provided for each cylinder.

To those skilled in the art to which this invention appertains, the above-described preferred embodiment may be subject to change or modification. Such change or modification can be carried out without departing from the scope of the invention, which is intended to be limited only by the scope of the appended claims.

The invention claimed is:

1. A hybrid fuel injection system for an internal combustion engine including a fuel reservoir, comprising:

at least one fuel injector having a nozzle;

at least one unit pump system, one unit pump system being connected between the fuel reservoir and respectively to each said fuel injector, each said unit pump system supplying fuel from the fuel reservoir to each said fuel injector, each said unit pump system comprising:

a cam having a cam profile; and a cam roller follower operatively following said cam profile, said unit pump system providing, responsive to said cam profile, a main fuel injection at the nozzle of the respective fuel injector that is connected to the respective unit pump system;

a common rail system connected commonly between the fuel reservoir and each said fuel injector, said common rail system further including a pressure fuel pump for supplying pressurized fuel from the fuel reservoir to each said fuel injector; and an electronic controller selectively controlling said common rail system to supply pressurized fuel to each said fuel injector for providing at least one secondary fuel injection thereto, individually with respect to each fuel injector at the nozzle thereof independently of the cam profile of each said unit pump system, respectively.

2. The system of claim 1, wherein said common rail system comprises:

a fuel pump having a low pressure input and a high pressure output;

an accumulator connected to said high pressure output; and at least one solenoid valve connected to said accumulator, one said solenoid valve being connected respectively to each fuel injector, each solenoid valve being connected to said electronic controller.

3. The system of claim 2, wherein each fuel injector has a fuel input, said system further comprising with respect to each fuel injector:

a unit pump system check valve between the unit pump system of the respective fuel injector and the fuel input of the respective fuel injector; and a common rail system check valve between the solenoid valve of the respective fuel injector and the fuel input of the respective fuel injector.

4. The system of claim 2, wherein each fuel injector comprises:

said nozzle thereof;

a fuel input connected to the respective unit pump system of the fuel injector;

a nozzle assembly communicating between said nozzle and said fuel input, said nozzle assembly selectively injecting furl from said unit pump system via said nozzle;

a fuel port connected to the solenoid valve of said common rail system respectively of the fuel injector, and a sac communicating with said fuel port and said nozzle;

wherein fuel is injectable by said common rail system via the nozzle responsive to said electronic module independent of action of said nozzle assembly.

* * * * *